US009506635B2

(12) United States Patent
Gattari

(10) Patent No.: US 9,506,635 B2
(45) Date of Patent: Nov. 29, 2016

(54) LIGHTING APPARATUS HAVING A COVER WITH OPTICAL SECTION AND COVER SECTION WITH HINGING MEANS INTERPOSED THEREBETWEEN

(71) Applicant: ENEL SOLE S.R.L., Rome (IT)

(72) Inventor: Massimo Gattari, Potenza Picena (IT)

(73) Assignee: ENEL SOLE S.R.L., Rome (IT)

( * ) Notice: Subject to any disclaimer, the term of this patent is extended or adjusted under 35 U.S.C. 154(b) by 35 days.

(21) Appl. No.: 14/374,825

(22) PCT Filed: Jan. 25, 2013

(86) PCT No.: PCT/IT2013/000024

§ 371 (c)(1),
(2) Date: Jul. 25, 2014

(87) PCT Pub. No.: WO2013/111171

PCT Pub. Date: Aug. 1, 2013

(65) Prior Publication Data

US 2015/0023020 A1 Jan. 22, 2015

(30) Foreign Application Priority Data

Jan. 26, 2012 (IT) ..... 2012A0013

(51) Int. Cl.

| | |
|---|---|
| ***F21V 19/04*** | (2006.01) |
| ***F21S 8/08*** | (2006.01) |
| ***F21V 21/00*** | (2006.01) |
| *F21W 131/103* | (2006.01) |
| *F21W 131/10* | (2006.01) |

(Continued)

(52) U.S. Cl.

CPC ..... *F21V 19/042* (2013.01); *F21S 8/08* (2013.01); *F21S 8/086* (2013.01); *F21V 21/00* (2013.01); *F21V 19/04* (2013.01); *F21W 2131/10* (2013.01); *F21W 2131/103* (2013.01); *F21Y 2101/02* (2013.01); *F21Y 2105/00* (2013.01)

(58) Field of Classification Search

CPC .... F21V 19/04; F21V 19/042; F21V 19/045; F21V 19/047; F21V 21/00; F21S 8/081; F21S 8/083; F21S 8/088; F21S 8/085; F21S 8/086; F21W 2131/103; F21Y 2101/02

See application file for complete search history.

(56) References Cited

U.S. PATENT DOCUMENTS

| | | | |
|---|---|---|---|
| 3,506,153 A | 4/1970 | Hatch et al. | |
| 8,113,687 B2 * | 2/2012 | Villard | F21S 8/086 362/231 |

(Continued)

FOREIGN PATENT DOCUMENTS

| | | |
|---|---|---|
| WO | 2013001485 A1 | 1/2013 |
| WO | 2013111171 A1 | 8/2013 |
| WO | 2013155446 A1 | 10/2013 |

OTHER PUBLICATIONS

IT Search Report for IT RM20130605 mailed Jul. 15, 2014.

*Primary Examiner* — Robert May

(74) *Attorney, Agent, or Firm* — Thomas | Horstemeyer, LLP

(57) ABSTRACT

Lighting appliance provided with an outer chassis made in such a way as to permit the operator to comfortably perform in situ a repair or maintenance operation if needed. Said chassis makes it possible to efficiently separate the light emission devices and the reflector and refractor means associated thereto from the power supply means guaranteeing that the section containing the LED devices is such as to ensure the required level of insulation from external elements, such as IP55 or more preferably IP67, even after the chassis has been opened and said section has been separated from the rest of the chassis.

17 Claims, 2 Drawing Sheets

(51) Int. Cl.
*F21Y 101/02* (2006.01)
*F21Y 105/00* (2016.01)

(56) References Cited

U.S. PATENT DOCUMENTS 8,256,919 B2 * 9/2012 Holder ..... F21V 19/001 257/79
8,783,917 B2 * 7/2014 Mrakovich ..... F21V 23/003 362/217.14
2005/0141219 A1 6/2005 Skegin
2007/0253198 A1 * 11/2007 Pelegrin ..... F21S 8/086 362/246
2008/0002399 A1 1/2008 Villard
2008/0068799 A1 * 3/2008 Chan ..... F21V 29/004 361/697
2008/0080188 A1 4/2008 Wang

* cited by examiner

LIGHTING APPARATUS HAVING A COVER WITH OPTICAL SECTION AND COVER SECTION WITH HINGING MEANS INTERPOSED THEREBETWEEN

CROSS-REFERENCE TO RELATED APPLICATION

This application is the 35 U.S.C. §371 national stage of PCT Application No. PCT/IT2013/0000240, filed Jan. 25, 2013, which is herein incorporated by reference in its entirety and which also claims priority to, and the benefit of, Italian Patent Application FI2012A000013, filed Jan. 26, 2012, which is herein incorporated by reference in its entirety.

FIELD OF THE INVENTION

The present invention relates to the technical field of lighting devices and apparatuses, in particular to the field of public and street lighting devices and apparatuses.

STATE OF THE ART

In the field of public and street lighting, lighting appliances using semiconductor light sources such as LEDs (Light Emitting Diodes) are becoming increasingly well established.

The use of LEDs makes it possible to produce lighting appliances characterised by a greater flexibility of use, greater energy efficiency and greater modularity.

The lighting appliances comprising LEDs generally comprise a plurality of LEDs, provided with relative optics and reflectors, suitable dissipators associated to said LEDs and appropriate power supply means suitable for providing the power supply current needed to said plurality of LEDs.

The appliances using semi-conductor light sources have a more complex internal structure than the corresponding appliances using traditional light sources. The use of semiconductor light sources and corresponding power supply means permits a high degree of miniaturisation which is reflected in construction solutions of extremely reduced dimensions compared to the past.

The reduced dimensions of the lighting appliances entail obvious requirements to optimise the inner spaces which must house the components needed to ensure the necessary dissipation of heat generated by the electronic devices during their functioning and leave the operating space needed to perform maintenance and repairs.

In essence, the inner spaces of the aforesaid lighting appliances comprising electronic devices, not only must be such as to efficiently house the necessary electronic components but must also be organised in an easily accessible manner to simplify any in situ maintenance operations, particularly important in the case of public or street lighting, usually located in difficult positions for maintenance technicians to reach.

The patent application US2010/0172131 relates to an LED appliance for street lighting comprising an outer chassis, an LED module and a heat dissipation module. The LED module and the heat dissipation module being positioned inside said chassis. The LED module includes a frame, an electronic circuit bearing a plurality of LEDs, and a regulation mechanism of the lighting intensity. As shown by the figures appended to the application US2010/0172131, and in particular by FIG. 2, said outer chassis comprises a base and a cover inside which the various parts are housed and interconnected. It is clear that with such a structure, in the case of a need for maintenance or repair operations, the operator must preferably remove the lighting appliance from the post and take it to a suitable place for dismantling. In situ operations, while not impossible, are certainly extremely difficult given the position of the chassis cover and the relative attachment screws. The need to perform the maintenance operation not in situ also arises from the fact that opening the chassis exposes the LED devices to external atmospheric agents and this may represent a serious problem if exposure is prolonged over time. Humidity and impurities may in fact deposit on the emitting surfaces of the LEDs and on their dissipators considerably reducing the respective emission and dissipation capacity and causing, ultimately, a reduction of the performance and of the duration of the lighting appliance.

The patent U.S. Pat. No. 7,775,692 also relates to an LED street lighting appliance comprising an outer chassis inside which the light emitter devices and the relative power supply units with associated dissipators are housed. In this case too, the appended figures show a structure similar to that of the appliance described in the patent application US2010/0172131 as above, said outer chassis comprises a base and a cover inside which the various parts are housed and interconnected. In this case too, a maintenance or repair operation in situ is certainly complicated by the fact that said outer chassis substantially needs to be dismantled to be opened, an operation, which may prove complicated if not prohibitive on account of the functioning position of the lighting appliance suspended various meters above the ground.

The patent application FR2913484 describes an LED appliance for street lighting comprising an outer chassis, again provided with a base and a cover such that access to the inner parts necessarily entails the dismantling of the entire appliance making in situ maintenance or repair operations extremely difficult.

The United States patent application US 2008/0080188 describes a modular group for an LED light according to the preamble in claim 1. In the event of maintenance or repair operations being needed, the operator must preferably remove the unit from the support post and take it to a suitable place for dismantling.

The United States patent application US 2005/0141219 describes a lighting appliance for indoor lighting. In relation to such appliance, maintenance and repair operations in situ will be very difficult on account for example of the position of the cover which forces the operator to work from underneath in a particularly awkward position.

The United States patent application US 2008/0002399 describes an LED modular lighting appliance for street lighting. In relation to such lighting appliance too, maintenance and repair operations in situ will be very difficult on account, for example, of the position of the cover which forces the operator to work from underneath and at a relatively great height in a particularly awkward position and manner.

The lighting appliance according to the present invention resolves the technical problem related to the drawbacks described above by introducing a lighting appliance provided with an outer chassis made in such a way as to permit the operator to comfortably perform in situ a repair or maintenance operation if needed. Said chassis makes it possible to efficiently separate the light emission devices and the reflector and refractor means associated thereto from the power supply means and permits simplified access to the inside without the need to remove screws (or with the need to remove only a few screws, for example two screws), movable attachment parts or covers. As well as this, the lighting appliance according to the invention provides that the section containing the LED devices is such as to guarantee the required level of insulation from external elements, such as IP55 or more preferably IP67, even after the chassis has been opened and said section has been separated from the rest of the chassis.

SUMMARY OF THE INVENTION

Figure 1:
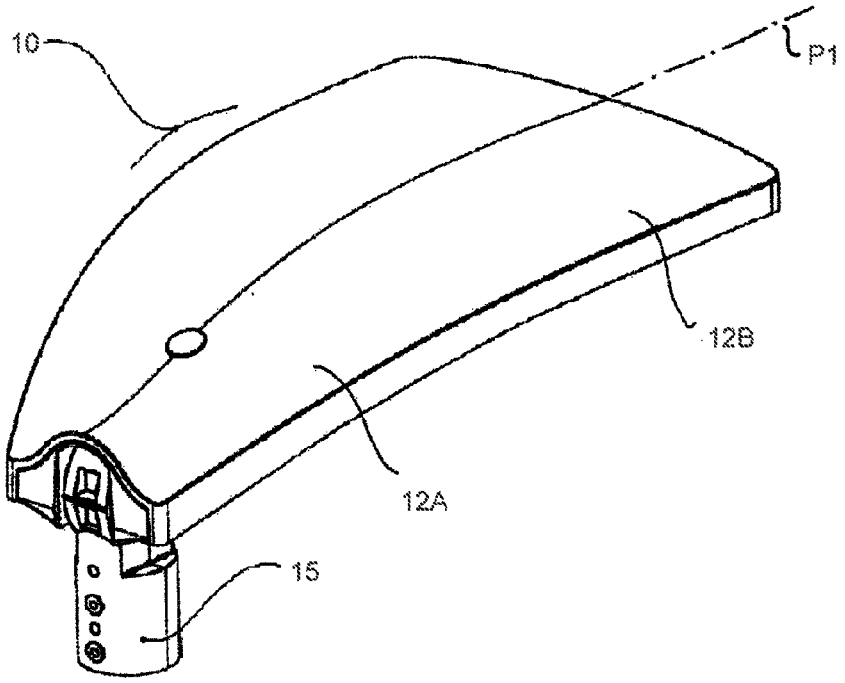
FIG. 1 shows a perspective view from above of the lighting appliance according to the present invention.

Lighting appliance provided with an outer chassis made in such a way as to permit the operator to comfortably perform in situ a repair or maintenance operation if needed. Said chassis makes it possible to efficiently separate the light emission devices and the reflector and refractor means associated thereto from the power supply means guaranteeing that the section containing the LED devices is such as to ensure the required level of insulation from external elements, such as IP55 or more preferably IP67, even after the chassis has been opened and said section has been separated from the rest of the chassis.

DETAILED DESCRIPTION OF THE INVENTION

With reference to the appended drawings, the lighting appliance according to the present invention comprises a chassis 10 in turn comprising a base 11 and a cover 12, connected by means of suitable hinging means such as to permit the aperture of said base 11 and said cover 12 while keeping them connected to each other.

Said cover 12, is suitable for receiving, in its widest part, a plurality of punctiform lighting devices 13 and, preferably, relative reflector and/or refractor means, the plurality of punctiform lighting devices preferably comprising high intensity LEDs (Light Emitting Diodes).

Said base 11 comprises an inner compartment 14 having sufficient capacity to house suitable power supply means for said plurality of punctiform lighting devices 13 and reversible coupling means 15 to support posts, where present.

Advantageously, said inner compartment 14 will comprise appropriate inner anchorage means, suitable for favouring the arrangement and attachment in a stable manner of said power supply means and a gasket, positioned along the rim of said inner compartment 14 and suitable for insulating said inner compartment 14 from the atmospheric agents when the lighting appliance according to the present invention is functioning. According to a preferred embodiment, the inner anchorage means are of a removable type, and comprise for example an accessory plate which is removable without the use of screws and which permits a rapid replacement of the LED power supply units.

The lighting appliance according to the present invention will comprise, in addition, appropriate seats suitable for housing connection cables between the devices housed in said inner compartment 14 and said punctiform lighting devices 13. Said cables will advantageously be fitted with suitable connectors so as to be able to easily separate the devices housed in said inner compartment 14 and said punctiform lighting devices 13.

Figure 3:
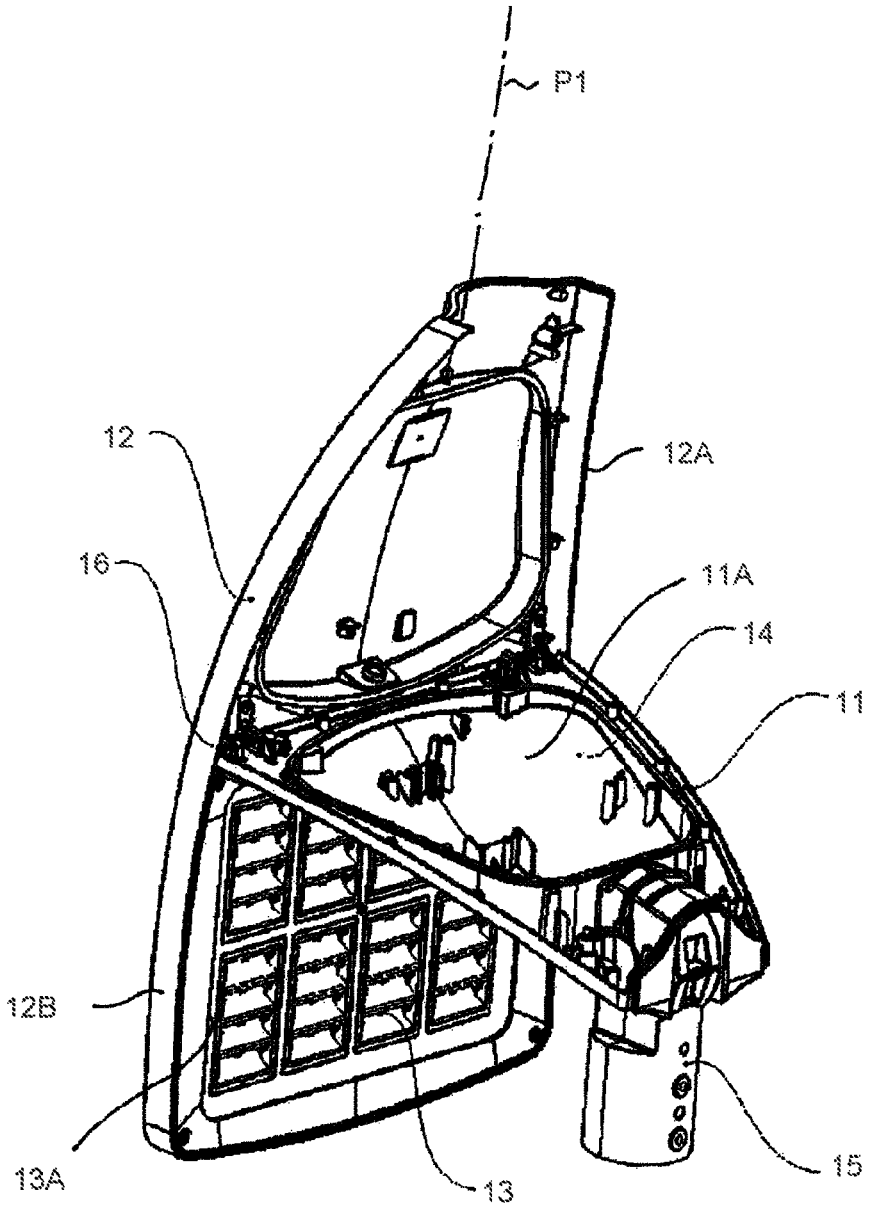
FIG. 3 shows a perspective view of the chassis of the lighting appliance according to the present invention, in an open position.

As may be seen clearly in FIG. 3, the cover 12 comprises a cover section 12A, or cover portion 12A, and an optical section 12B, or optical portion 12B. As may be seen in the appended drawings, the optical section 12B is provided to receive the aforesaid plurality of punctiform lighting devices 13 and, preferably, the relative reflector and/or refractor means, and is an extension of the cover section 12A. In particular, if, as in the example shown, the cover 12 has a main longitudinal direction of extension P1 (FIG. 1), the optical section 12B is an extension of the cover section 12B in the main longitudinal direction of extension P1.

Figure 2:
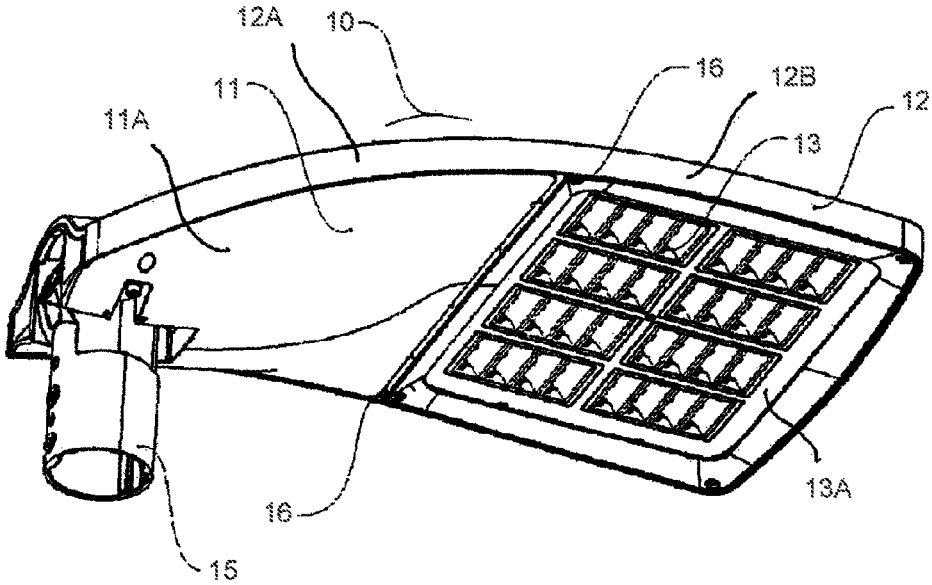
FIG. 2 shows a perspective view from below of the lighting appliance according to the present invention.

It is to be observed that the aforementioned hinging means are such as to permit the cover 12 to respectively assume, while keeping the base 11 and the cover 12 connected to each other, a closed configuration (FIGS. 1 and 2) and an open configuration (FIG. 3). In the closed configuration, the cover section 12A covers the inner compartment 14 (FIGS. 1 and 2). In the open configuration, the cover section 12A is positioned in such a way as to expose the inner compartment to permit access thereto (FIG. 3). In particular, as may be seen for example in FIG. 2, in the closed configuration of the cover the optical section 12B is positioned alongside the inner compartment 14. More in particular, in the closed configuration of the cover the optical section 12B is positioned laterally alongside the inner compartment 14. With cross-reference to the FIGS. 1-3, is it moreover evident that in the closed configuration of the cover 12 the cover section 12A and the base 11 are suitable for defining a closed or substantially closed chamber comprising the inner compartment 14. In particular, according to a currently preferred embodiment, such closed chamber has an IP67 protection level. As may be seen for example in FIG. 2, the optical section 12B extends outwards of such closed chamber.

With cross-reference to the FIGS. 2 and 3, one may observe that the base 11 comprises an bottom wall 11A suitable for defining the inner compartment 14, and the optical section 12B comprises a lighting face 13A suitable for being operatively crossed by the luminous radiation emitted by the punctiform lighting devices 13 received in the optical section 12B, and preferably, by the relative reflector and/or refractor means. In particular, as may be seen in FIG. 2, in the closed configuration of the cover 12 the lighting face 13A is substantially aligned and positioned alongside the bottom wall 11A. Again with reference to FIG. 2 one may also observe, that the optical section 12B is such as to receive the punctiform lighting devices 13 in such a way that in the closed configuration of the cover 12 the punctiform lighting devices 13, and preferably, the relative reflector and/or refractor means, are positioned to illuminate from the side opposite the cover section 12A.

The structure of the lighting appliance according to the present invention allows an operator to perform maintenance or repair operations in situ, in that the inner compartment 14 of said appliance is easily accessible without the need to dismantle parts and leaves both hands free to operate on the internal components without the need for auxiliary support surfaces on which to rest the dismantled arts and without having to adopt awkward positions on account of the position and orientation of the lighting appliance to be operated on.

Advantageously, said hinging means suitable for connecting said base 11 to said cover 12, are made by means of a pair of hinges 16 of the type with a removable pin. Advantageously, moreover, said pair of hinges 16 is positioned in such a way that the axis passing through said pair of hinges 16 is shifted, in relation to the barycentre of said cover 12, towards the area of lesser width, not comprising said punctiform lighting devices 13.

This makes it possible to achieve, when the cover 12 is opened, a naturally stable position of said cover 12 approximately orthogonal to said base 11 and such as to fully expose said inner compartment 14 to the operator.

As may be seen in FIGS. 2 and 3, the hinge axis of the hinging means, which in the example corresponds to the aforementioned axis passing through the pair of hinges 16, is positioned orthogonally or substantially orthogonally to the aforementioned main longitudinal extension direction P1.

The use of a pair of hinges 16 with removable pin instead permits, as needed, the separation of said cover 12, comprising a plurality of punctiform lighting devices 13 and preferably relative reflector and/or refractor means, from said base 11 and the replacement if necessary of the entire optical unit of the lighting appliance should it be required.

It may be observed that, by means of the lighting apparatus according to the present description, a public lighting apparatus may be provided, such as for example a lamp-post for street lighting, comprising a lighting apparatus according to the present description and a support post to which such lighting apparatus is attached. It is to be observed that the present invention also relates to such public lighting apparatus.

The invention claimed is:

1. Lighting apparatus comprising a chassis in turn comprising a base and a cover, connected by hinging means, said cover comprising a cover section and an optical section configured to receive a plurality of punctiform lighting devices, said base comprising an inner compartment and reversible attachment means to support posts where provided, said base and said cover being connected by hinging means such as to permit the cover to respectively assume, while keeping the base and the cover connected to each other, a closed configuration, in which the cover section covers the inner compartment, and an open configuration, in which the cover section is positioned so as to expose the inner compartment to permit access thereto, wherein the optical section is an extension of the cover section and is positioned alongside the inner compartment in said closed configuration of the cover, and wherein said hinging means are interposed between the optical section and the cover section of the cover, connecting the cover to the base.

2. Lighting apparatus according to claim 1, wherein the cover has a main longitudinal direction of extension and wherein the optical section is an extension of the cover section in said main longitudinal direction of extension.

3. Lighting apparatus according to claim 2, wherein the hinging means comprise a hinge axis which is positioned orthogonally or substantially orthogonally to said main longitudinal direction of extension.

4. Lighting apparatus according to claim 1, wherein in the closed configuration of the cover the cover section and the base are suitable for defining a closed or substantially closed chamber comprising the inner compartment, the optical section extending outwards to said closed chamber.

5. Lighting apparatus according to claim 1, wherein said base comprises a bottom wall suitable for defining the inner compartment, and the optical section comprises a lighting face suitable for being operatively crossed by the luminous radiation emitted by the punctiform lighting devices received in the optical section, wherein in the closed configuration of the cover said lighting face is substantially aligned and positioned alongside said bottom wall.

6. Lighting apparatus according to claim 1, wherein the optical section is such as to receive the punctiform lighting devices in such a way that in the closed configuration of the cover the punctiform lighting devices are positioned to illuminate from the side opposite the cover section.

7. Lighting apparatus according to claim 1, wherein the cover comprises said plurality of punctiform lighting devices.

8. Lighting apparatus according to claim 1, wherein said inner compartment is suitable for housing appropriate power supply means for said plurality of punctiform lighting devices and comprises appropriate inner anchorage means, suitable for favouring the arrangement and attachment in a stable manner of said power supply means.

9. Lighting apparatus according to claim 1, wherein said inner compartment comprises an inner compartment rim and a gasket positioned along said rim.

10. Lighting apparatus according to claim 1, comprising appropriate seats suitable for housing connection cables between at least a power supply housed in said inner compartment and said punctiform lighting devices.

11. Lighting apparatus according to claim 10, wherein said connection cables are provided with appropriate connectors suitable for separating a part of said cables connected to at least a power supply housed in said inner compartment from a part connected to said punctiform lighting devices.

12. Lighting apparatus according to claim 1, wherein the cover comprises an area of greater width and an area of lesser width, and wherein said hinging means comprise a pair of hinges positioned substantially at the center of the cover, wherein an axis passing through said pair of hinges is shifted, in relation to a barycentre of said cover, towards the area of lesser width, not comprising said punctiform lighting devices.

13. Lighting apparatus according to claim 12, wherein the cover is suitable for naturally assuming a stable position approximately orthogonal to said base and such as to fully expose the inner compartment to an operator.

14. Lighting apparatus according to claim 1, wherein said hinging means suitable for connecting said base to said cover, are made by hinging means with a removable pin.

15. Lamp-post for street lighting, comprising a lighting apparatus according to claim 1 and a support post to which such lighting apparatus is attached.

16. Lighting apparatus according to claim 1, wherein said optical section comprises said plurality of punctiform lighting devices and at least one of a reflector means or refractor means associated thereto.

17. Lighting apparatus according to claim 1, wherein the optical section is enclosed to provide ingress protection from environmental elements.

* * * * *